United States Patent [19]

Wakeman

[11] 3,935,615

[45] Feb. 3, 1976

[54] JOINT FORMING TAPE FOR A COLLAPSIBLE CYLINDRICAL CONTAINER

[76] Inventor: Alfred W. Wakeman, Madison Rd., Durham, Conn. 02422

[22] Filed: July 19, 1973

[21] Appl. No.: 380,589

[52] U.S. Cl. ..... 16/150; 229/41 R

[51] Int. Cl.[2] ..... E05D 7/00; B65D 5/36

[58] Field of Search ..... 229/4.5, 41 R, 41 B, 44; 217/65; 16/150, 149, 158, 159, 187, 185, 128

[56] References Cited

UNITED STATES PATENTS

| | | | |
|---|---|---|---|
| 1,276,174 | 8/1918 | Carter | 16/150 |
| 3,442,415 | 5/1969 | Glass | 16/150 |
| 3,751,760 | 8/1973 | Wakeman | 16/150 |

FOREIGN PATENTS OR APPLICATIONS

| | | | |
|---|---|---|---|
| 1,030,268 | 6/1953 | France | 16/150 |

*Primary Examiner*—Patrick D. Lawson
*Attorney, Agent, or Firm*—Merrill F. Stewart

[57] ABSTRACT

A collapsible cylindrical shipping container and joint-forming tape structure therefor is disclosed, wherein the cylindrical side of the container is formed of at least two relatively stiff but flexible sheet wall members having mating edges joined by a tape structure of X-like configuration permitting the wall members to be flexed from a normal collapsed, face-to-face position into an expanded volume-defining position. This latter relationship is maintained by the insertion of end closure means in at least one end of the container thus formed. A joint-forming tape structure used in the container is also disclosed.

7 Claims, 9 Drawing Figures

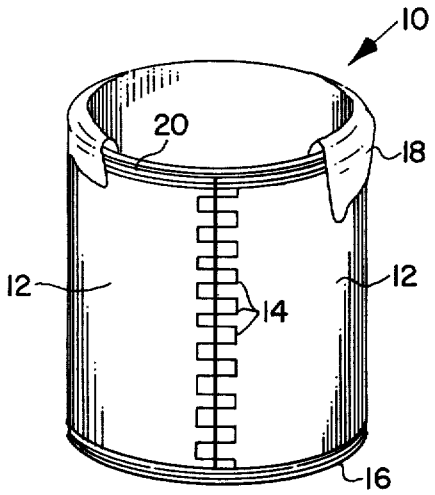
FIG. 1
FIG. 2
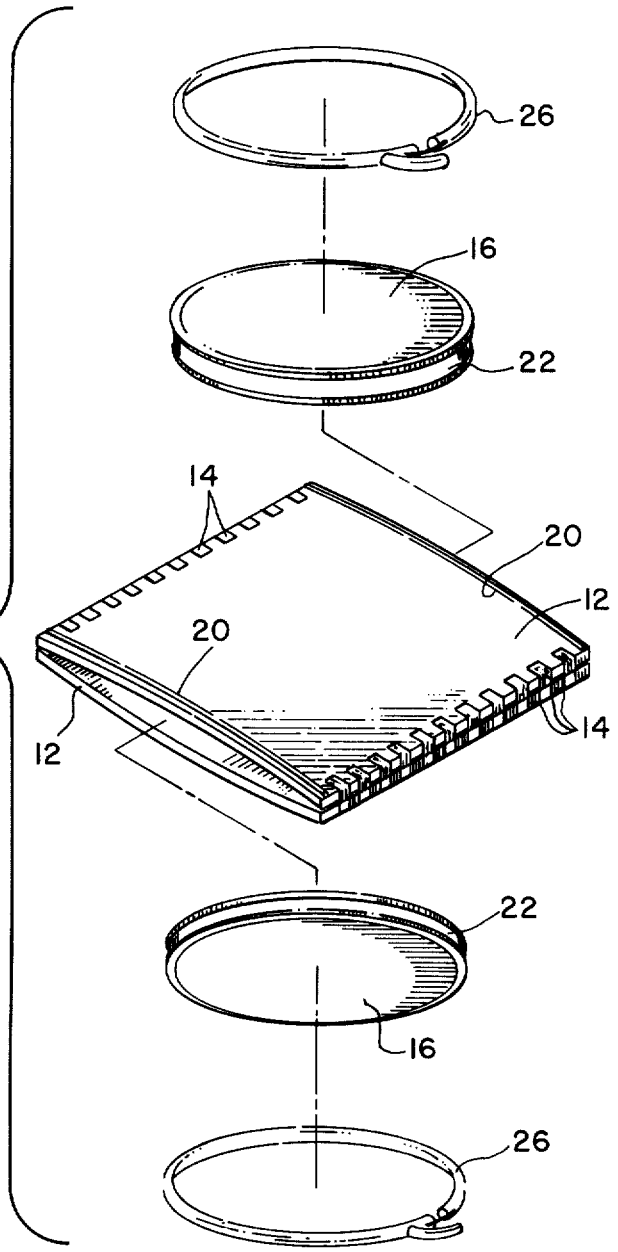
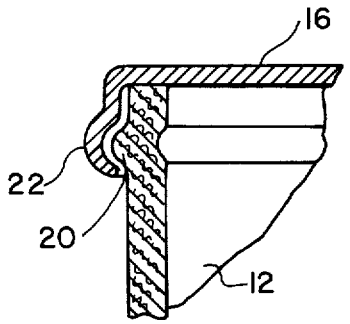
FIG. 3
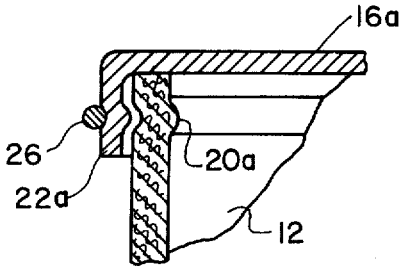
FIG. 4
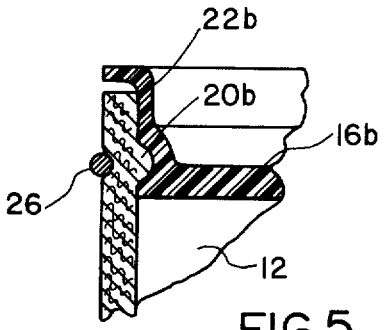
FIG. 5

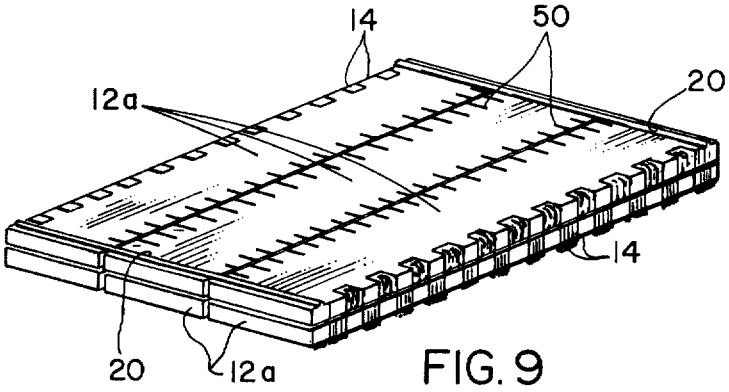
FIG. 9
FIG. 6
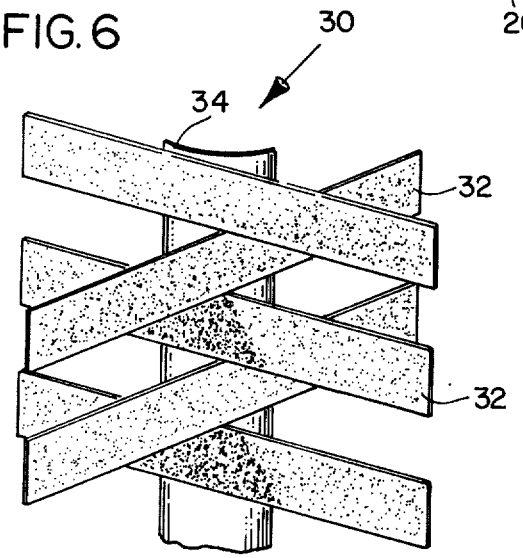
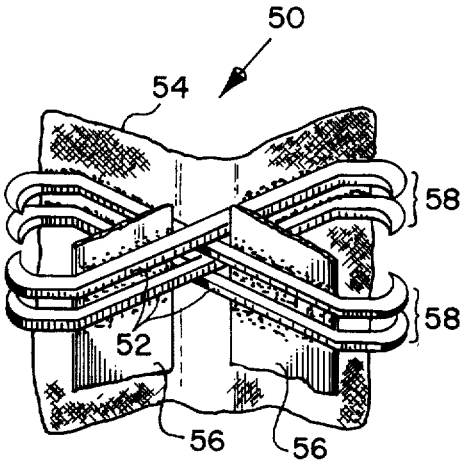
FIG. 8
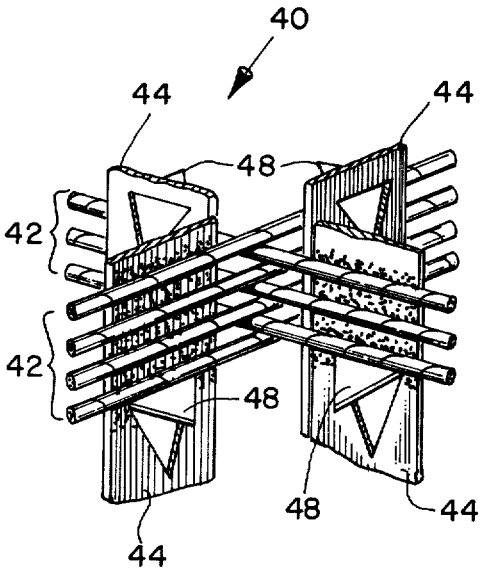
FIG. 7

JOINT FORMING TAPE FOR A COLLAPSIBLE CYLINDRICAL CONTAINER

CROSS REFERENCE TO RELATED APPLICATIONS

This application is copending with my prior application Ser. No. 159,796, filed July 6, 1971, now U.S. Pat. No. 3,751760, which is directed to tape structures of a type similar to those used in carrying out this invention.

FIELD OF THE INVENTION

This invention pertains to collapsible cylindrical shipping containers, and more especially to cyclically reusable containers, and a joint-forming tape structure employed therein for connecting semi-rigid but flexible sidewall forming members to permit these to be flexed between a collapsed, substantially flat, empty-return condition, and an expanded, volume-defining condition for retention of a product in transit.

PRIOR ART BACKGROUND

Substantial use has been made of shipping containers which are repeatedly used to contain a product in transit and then returned empty for further re-use. For reasons of shipping volume economy alone it is obvious that containers which are collapsible for return and reuse have many advantages over containers of fixed, non-collapsible design. This collapsibility is not so difficult to achieve in a rectangular shipping container; however the problem becomes much more complex in its application to cylindrical containers such as drums or barrels. But the latter frequently have structural advantages as shipping containers over rectangular designs, more particularly in terms of unit stress conditions in the loaded container, which makes their use desirable in many instances. Prior cylindrical containers, unless made of highly flexible film or the like and therefore subject to easy rupture or puncture, have not been capable of being collapsed for empty-return. The approach to the problem, rather, has been in terms of nesting designs which offer only a partial solution.

The present invention provides a container of drum or cylinder configuration which possesses all of the desirable characteristics of a fixed drum or barrel type previously available, including the use of puncture resistant semi-rigid fiberboard side wall construction, but which unlike such prior drum or barrel types is collapsible into a flat condition for empty-return and repeated reuse cycling.

SUMMARY OF THE INVENTION

The invention is characterized by the provision of at least two generally rectangular sheet members which preferably are of heavy, stiff but bendable fiberboard stock. These are joined along mating edges by an X-like joint-forming structure to form a peripherally continuous side wall in which the sheet members can be moved from a substantially flat, facially-contacting, collapsed condition to a flexed, volume-defining or cylindrical condition. Closure means, preferably circular discs of stiff sheet material, are removably inserted in the open ends of the wall members when flexed to volume-defining position. One such disc serves to retain the side members in the last-mentioned position in order to fill the container with a product for shipment, and a second disc serves as the final closure means after the container is filled. Removal of the closure discs on delivery of the product enables the containers to be returned for further use in collapsed condition, thus effecting great saving in space requirements for the empty containers during return shipment and storage. An essential feature of the invention lies in the design of a structure for articulately joining the side-forming panels of the container so that the aforesaid collapsibility is obtained without deteriorating the integrity of the wall in its volume-defining, product-retaining condition.

The invention is illustrated by the embodiment in a container shown in the accompanying drawings, wherein FIG. 1 is a perspective view of a partially assembled drum;

FIG. 2 is an exploded perspective view of the components of the drum in collapsed, disassembled condition;

FIGS. 3, 4 and 5 are fragmentary sectional views of alternative closure forming arrangements for the container.

FIGS. 6 and 7 are fragmentary perspective views of alternative joint structures for hingedly joining side forming panels of the drum;

FIG.8 is a fragmentary perspective view of another joint structure; and

FIG. 9 is a perspective view of a side panel arrangement for a container employing join structures of the type shown in FIG. 8.

A container embodying the invention is shown in FIG. 1 in set-up condition ready to receive a product to be shipped, while FIG. 2 shows the component parts of the container in knocked-down condition for economy of storage or return shipment of the empty container.

Container 10 takes the form of a drum composed of a pair of relatively stiff, puncture-resistant, fiberboard sheet panels 12 which are connected along a pair of opposite edges by a joint structure 14, more fully discussed hereinafter. The joined panels are movable from a collapsed, substantially flat, face-to-face contacting position, as seen in FIG. 2, to an expanded or volume-defining position, as seen in FIG. 1. This is done by flexing the panels intermediate joints 14 to cause them to assume the generally cylindrical side wall configuration seen in FIG. 1. In this position panels 12 are under a bending stress which urges them to reassume their original flat condition; however this is prevented in the erected container by inserting a circular closure disc 16 into an open end of the structure to provide a bottom wall. The resulting open-top receptacle can then be charged with a variety of products, after which a second closure disc 16 is inserted into the open upper end of the container to complete the enclosure.

As illustrated in FIG. 1, a lining 18 is provided, which typically may consist of a thin-walled bag of polyethylene film or the like. This can be hermetically sealed to further protect the product from atmosphere.

Various arrangements can be employed for securing end closures 16 to panels 12 in forming the container, and several variant forms are shown in FIGS. 3 through 5. In FIG. 3, an external chime 20 is permanently pressed into the margins of panel members 12 at their opposite free edges, and closure disc 16 comprises a sheet metal stamping having a peripheral, flanged lip 22 configured to frictionally grip chime 20. The arrangement seen in FIG. 4 is generally similar, with the exception that chime 20*a* is internally formed in panels 12, and lip 22*a* of closure disc 16a is formed to provide an internal rib for mating engagement with the chime. For added security of retention of the closure on the container, a tension band 26 may be placed in the peripheral depression of flange 22*a* and tightened to increase the gripping of the lip with the chime. Still another arrangement is shown in FIG. 5 in which an internally formed chime 20*b* is gripped internally of panels 12 by an end closure disc 16*b* which is here illustrated as being formed of molded plastic material. Disc 16*b* is likewise formed with an annular lip or flange 22*b* adapted to frictionally engage the chime of panels 12. Again a tension band 26 can be employed to further secure the frictional engagement between the side and end closure members.

An important aspect of the invention lies in the form of joint structure used in connecting panels 12 to permit them to be moved from collapsed to volume-defining position. One such joint forming structure is illustrated more particularly in FIG. 6. A special tape 30 is used which is composed of a series of connector members 32 which, at least initially, are connected to and supported by a longitudinal carrier 34. Connector members 32 are disposed in spaced relation along carrier 34 in alternating, intersecting relation to form an X-like configuration looked at in cross section. Both of cross members 32 and carrier 34 are preferrably formed of flexible sheet material having good tensile strength, such as sheet plastic or woven fabric material. Strong paper, such as kraft is also suitable in some instances, depending upon load-carrying requirements or other structural considerations.

Tape 30 is applied along the opposite edges of panels 12 with the margins of the panels clamped between adjacent legs of the X-like tape, the margins being disposed in diametrically opposite quadrants of the X. For most applications, cross members 32 may be secured to the panels by means of suitable adhesive which can be applied initially to the margins of the panels, or to the cross members, or to both. In some instances, tape 30 may carry a pressure sensitive adhesive on the connector members to facilitate application of the tape to panel members 12 in the initial fabrication of the container components. The use of such pressure sensitive adhesive is of particular advantage where it may be desirable to remove carrier 34 after cross members 32 have been secured to the panel margins. That is, carrier 34 may be employed simply as a means for maintaining the cross members in properly oriented position prior to their application to the margins of panels 12, and once this has been achieved it is no longer needed and may be stripped away.

A modification in the means for forming a flexible joint between adjacent panel members is shown in FIG. 7, wherein structure 40 comprises a series of alternately intersecting cross members 42 of flexible strand material which are supported in properly oriented relation to each other by four thin, relatively stiff metal carrier strips 44, one such strip running along each leg of the X-like configuration. Again adhesive is employed for securing the carrier strips 44 to the cross members, and in this instance the metal carrier strips are punched or struck to form piercing tabs or teeth 48. These can be driven into the margins of the panel members to be joined in order to help secure the joint structure. Glue or other adhesive may also be used for this purpose, and again the carrier strip can be made removable and dispensed with after serving to assist to apply the cross members. In such case, the piercing tabs would of course not be used.

A modified form of joint structure is illustrated in FIGS. 8 and 9. In this instance a junction strip 50 is provided which again consists of a series of connector members 52 running crosswise of the joint to be formed, each of such connector members 52 intersecting and crossing other similar members in alternating series along the joint to form the X-like configuration. In this instance, however, cross members 52 are formed of substantially stiff material, such as metal wire, rod or bar. Again these members are held in properly oriented relation by a longitudinal carrier member 54 of sheet or webbing material which carries an adhesive to secure the cross members to it. In this instance supplemental longitudinal carrier strips 56 are also shown, one such carrier strip 56 being disposed along each leg of the X-configuration not in contact with carrier 54. Supplemental carriers 56 may be metal and relatively non-flexible, or flexible as desired, in either case pressure sensitive adhesive being provided along their exposed faces so that, when brought into contact with the margin of the panel member to be joined, such adhesive helps to secure the structure to the panels to form the joint. The embodiment as illustrated in FIG. 8 also incorporates clamping teeth 58 formed in the ends of cross members 52 which may be driven or crimped into the panel material when strip 50 is applied.

In the foregoing discussion the means for joining the cross members and carrier means has again been referred to as an adhesive, which is generally preferable where at least one of the elements is of fabric or plastic sheeting. It will be apparent however that the structure of FIG. 8 may consist of all metal elements; that is, the cross members may be rectangular or round metal rod and the longitudinal carrier members strip metal. In such a case spot welding of the elements affords a good means for joining them together, especially since as discussed below normal use of the joint structure here illustrated will impose loading stresses on the joint which are in shear, and spot welding exhibits its greatest strength in shear.

It will be apparent that junction strip 50 can not be employed to form a freely articulating joint between adjacent panel members due to the stiffness of cross members 52. Such a junction strip has utility, however, where it may be desirable to connect a series of narrower panels to form a composite panel of greater width, as seen in FIG. 9. Although junction strip 50 does not permit free articulation between the narrower panel strips 12a required at the side margins forming joint 14 in FIG. 1, breaking up of the width of panels 12 into a series of narrower panels 12a by means of junction strips 50 will provide some greater ease of bending of the panels into the circular configuration assumed in the erected container. Thus even though it is relatively stiff, junction strip 50 can be made to permit some bending and unbending to take place to facilitate setting up and disassembling a container.

Just as the joint structure may be all-metal, so also may a container of the invention be made using metal panels instead of fiber or plastic sheet. The foregoing illustrations will suggest further modifications possible within the concept of the invention. For example, more than two panel members may be interconnected by fully articulatable joint structures. Such an arrangement will be useful in providing containers of other than circular cross section, in which event of course end closure members of conforming shape must be provided. It will also be useful where the panel members employed are metal sheet, as mentioned above. The following claims are accordingly intended to be interpreted in the light of the concept disclosed without limitation to specific non-essential elements of the specific illustrations given above.

What is claimed is:

1. An elongated joint-forming structure for interconnecting contiguous panel members having mating edges, said structure comprising a series of connector members each running crosswise of the joint to be formed and disposed in spaced relation therealong, at least some of said cross members intersecting and crossing other of said members in alternation along the joint to form an X-like configuration, and carrier means comprising at least one longitudinal member from which each of said cross members is supported in said X-like configuration with the ends of said cross members extending marginally outwardly of said carrier means, and means on either said cross members or carrier means securing them together to form said structure.

2. A joint-forming structure as defined in claim 1, wherein said carrier means comprises a single flexible longitudinal member secured to said cross members adjacent their points of intersection.

3. A joint-forming structure as defined in claim 1, wherein said cross members are substantially stiff and inflexible.

4. A joint-forming structure as defined in claim 3, wherein said cross members are metal.

5. A joint-forming structure as defined in claim 1, wherein said longitudinal member is relatively stiff and inflexible.

6. A joint-forming structure for interconnecting contiguous panel members having mating edges, said structure comprising a series of connector members each running crosswise of the joint to be formed and disposed in spaced relation therealong, at least some of said cross members intersecting and crossing other of said members in alternation along the joint to form an X-like configuration, and carrier means comprising a single flexible strip secured to said connector means substantially along the axis of the structure formed thereby, and means on either said cross members or carrier means securing them together to form said structure.

7. A joint-forming structure as defined in claim 6, wherein said carrier member is removably secured to said connector members to permit removal thereof after formation of a joint by said structure between panel means.

* * * * *